US010209643B2

(12) United States Patent
Ikebata

(10) Patent No.: US 10,209,643 B2
(45) Date of Patent: Feb. 19, 2019

(54) TONER CONTAINER THAT RESTRICTS REMOVAL FROM MOUNTING PORTION AND IMAGE FORMING APPARATUS

(71) Applicant: KYOCERA Document Solutions Inc., Osaka (JP)

(72) Inventor: Yoshiaki Ikebata, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/925,235

(22) Filed: Mar. 19, 2018

(65) Prior Publication Data

US 2018/0284645 A1 Oct. 4, 2018

(30) Foreign Application Priority Data

Mar. 30, 2017 (JP) ..... 2017-066851

(51) Int. Cl.
*G03G 15/08* (2006.01)

(52) U.S. Cl.
CPC ..... *G03G 15/0872* (2013.01); *G03G 15/0856* (2013.01); *G03G 15/0877* (2013.01); *G03G 2215/0665* (2013.01)

(58) Field of Classification Search
CPC ..... G03G 15/0868; G03G 15/087; G03G 15/0872; G03G 2215/067; G03G 2215/0668; G03G 2215/0665
USPC ..... 399/262, 263
See application file for complete search history.

(56) References Cited

U.S. PATENT DOCUMENTS

| | | | | |
|---|---|---|---|---|
| 9,122,202 | B2 * | 9/2015 | Hori | G03G 15/0886 |
| 2009/0080909 | A1 * | 3/2009 | Usui | G03G 15/0863 399/13 |
| 2017/0115596 | A1 * | 4/2017 | Nakajima | G03G 15/0872 |

FOREIGN PATENT DOCUMENTS

| | | | |
|---|---|---|---|
| JP | 10-48931 | A | 2/1998 |
| JP | 10319693 | A * | 12/1998 |
| JP | 2002139905 | A * | 5/2002 |

* cited by examiner

*Primary Examiner* — Robert B Beatty
(74) *Attorney, Agent, or Firm* — Stein IP, LLC

(57) ABSTRACT

A toner container is for mounting to a mounting portion of an image forming apparatus along a mounting direction. The toner container includes a container body and an engaging protrusion. The container body houses a toner and rotates. The engaging protrusion projects from an outer peripheral surface of the container body. The engaging protrusion has a spiral pattern and rotates integrally with the container body. The mounting portion includes a lock portion is engageable with the engaging protrusion. Rotation of the container body and the engaging protrusion in one rotation direction in a state where removal of the toner container from the mounting portion is permitted causes the toner container to move to a back side (downstream) in the mounting direction while shifting an engaging part of the engaging protrusion relative to the lock portion to restrict the removal of the toner container from the mounting portion.

7 Claims, 5 Drawing Sheets

TONER CONTAINER THAT RESTRICTS REMOVAL FROM MOUNTING PORTION AND IMAGE FORMING APPARATUS

INCORPORATION BY REFERENCE

This application is based upon, and claims the benefit of priority from, corresponding Japanese Patent Application No. 2017-066851 filed in the Japan Patent Office on Mar. 30, 2017, the entire contents of which are incorporated herein by reference.

BACKGROUND

Unless otherwise indicated herein, the description in this section is not prior art to the claims in this application and is not admitted to be prior art by inclusion in this section.

A typical electrophotographic-method image forming apparatus performs a development process by supplying toner to an electrostatic latent image formed on a surface of an image carrier (for example, a photoreceptor drum) from a developing device. Toner used for such a development process is replenished to a developing device from a toner container. The above-described toner container includes, for example, a container body that houses toner to rotate.

The above-described toner container is mounted to a mounting portion located in the image forming apparatus and is removed from the mounting portion when the toner inside the container body becomes empty to be replaced with a new toner container. In employing such a configuration, removing the toner container from the mounting portion before the toner inside the container body becomes empty is not economical since the toner inside the container body cannot be used up. Therefore, removal of a toner container from a mounting portion is sometimes restricted by a lock mechanism until toner inside a container body becomes empty.

SUMMARY

A toner container according to one aspect of the disclosure is for mounting to a mounting portion of an image forming apparatus along a mounting direction. The toner container includes a container body and an engaging protrusion. The container body houses a toner and rotates. The engaging protrusion projects from an outer peripheral surface of the container body. The engaging protrusion has a spiral pattern and rotates integrally with the container body. The mounting portion includes a lock portion is engageable with the engaging protrusion. Rotation of the container body and the engaging protrusion in one rotation direction in a state where removal of the toner container from the mounting portion is permitted causes the toner container to move to a back side (downstream) in the mounting direction while shifting an engaging part of the engaging protrusion relative to the lock portion to restrict the removal of the toner container from the mounting portion.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
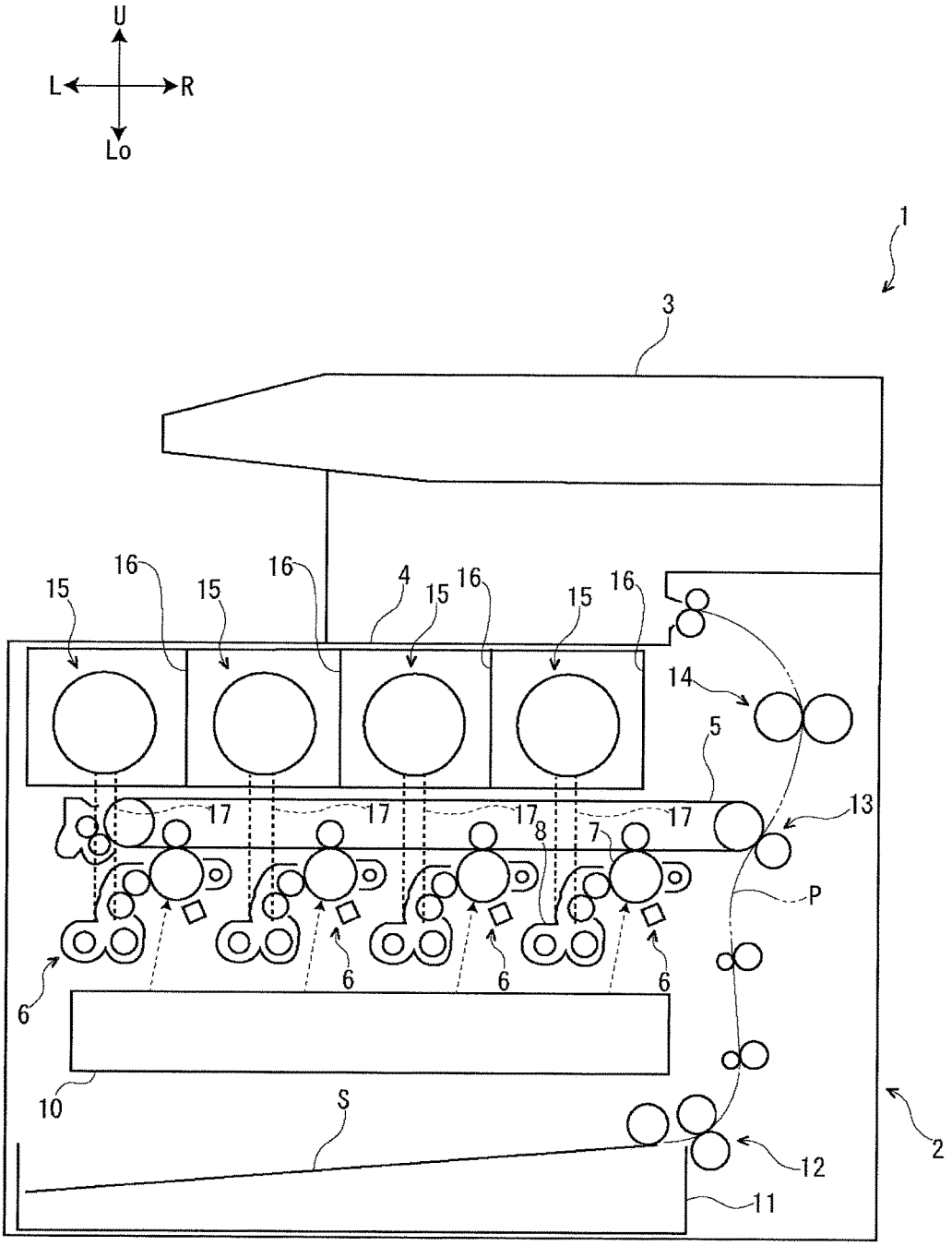
FIG. 1 schematically illustrates an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an image forming apparatus 1 according to one embodiment of the disclosure with reference to the accompanying drawings. The image forming apparatus 1 is a multi-functional peripheral that includes, for example, a print function, a copy function, a fax function and similar function. Arrows Fr, Rr, L, R, U, and Lo attached as appropriate in the respective drawings indicate a front side, a rear side, a left side, a right side, an upper side, and a lower side of the image forming apparatus 1, respectively.

First, a description will be given of an overall configuration of the image forming apparatus 1.

As illustrated in FIG. 1, the image forming apparatus 1 includes a box-shaped apparatus main body 2. In an upper end portion of the apparatus main body 2, an image reading apparatus 3 for reading a document image is located.

In an upper portion of the apparatus main body 2, a sheet discharge tray 4 is located. At an approximately central portion of the apparatus main body 2, an intermediate transfer belt 5 and four image forming units 6 are housed. The respective image forming units 6 correspond to, for example, toners of black, cyan, magenta, and yellow. The image forming units 6 each include a photoreceptor drum 7 (an exemplary image carrier) and a developing device 8. In a lower portion of the apparatus main body 2, an exposure apparatus 10 is housed. At a lower end portion of the apparatus main body 2, a sheet feed cassette 11 that houses a paper sheet S (an exemplary recording medium) is housed.

In a right side portion of the apparatus main body 2, a conveyance path P of the paper sheet S is located. At an upstream end portion of the conveyance path P, a paper sheet feeder 12 is located. In a midstream portion of the conveyance path P, a secondary transfer unit 13 is located. In a downstream portion of the conveyance path P, a fixing unit 14 is located.

In the upper portion of the apparatus main body 2, four toner containers 15 (an exemplary toner container) are housed below the sheet discharge tray 4. The respective toner containers 15 correspond to, for example, the toners of black, cyan, magenta, and yellow. In the upper portion of the apparatus main body 2, four mounting portions 16 are located. At the respective mounting portions 16, the respective toner containers 15 are removably mounted. In an approximately central portion in a vertical direction of the apparatus main body 2, four hoppers 17 are located. The respective hoppers 17 connect the respective toner containers 15 to the developing devices 8 of the respective image forming units 6.

Next, a description will be given of an exemplary operation of the image forming apparatus 1.

First, the lights (see dotted line arrows in FIG. 1) from the exposure apparatus 10 forms electrostatic latent images on the photoreceptor drums 7 of the respective image forming units 6. These electrostatic latent images are developed by the developing devices 8 of the respective image forming units 6. This causes the photoreceptor drums 7 of the respective image forming units 6 to carry a toner image. The toner image is primarily transferred to the intermediate transfer belt 5 from the photoreceptor drums 7 of the respective image forming units 6. This forms a full-color toner image on the intermediate transfer belt 5.

The paper sheet S taken out of the sheet feed cassette 11 by the paper sheet feeder 12 is conveyed to the downstream side in the conveyance path P to enter the secondary transfer unit 13. At the secondary transfer unit 13, the full-color toner image formed on the intermediate transfer belt 5 is secondarily transferred to the paper sheet S. The paper sheet S where the toner image is secondarily transferred is further conveyed to the downstream side in the conveyance path P to enter the fixing unit 14. The fixing unit 14 fixes the toner image to the paper sheet S. The paper sheet S where the toner image is fixed is discharged on the sheet discharge tray 4.

Next, a description will be further given of the four toner containers 15. The configurations of the respective toner containers 15 are similar; thus, in the following, one toner container 15 will be described and the remaining three toner containers 15 will not be elaborated here. Arrows O attached in the respective drawings on and after FIG. 2 indicate an outside in a front-rear direction of the toner container 15, and arrows I attached in the respective drawings on and after FIG. 2 indicate an inside in the front-rear direction of the toner container 15.

Figure 2:
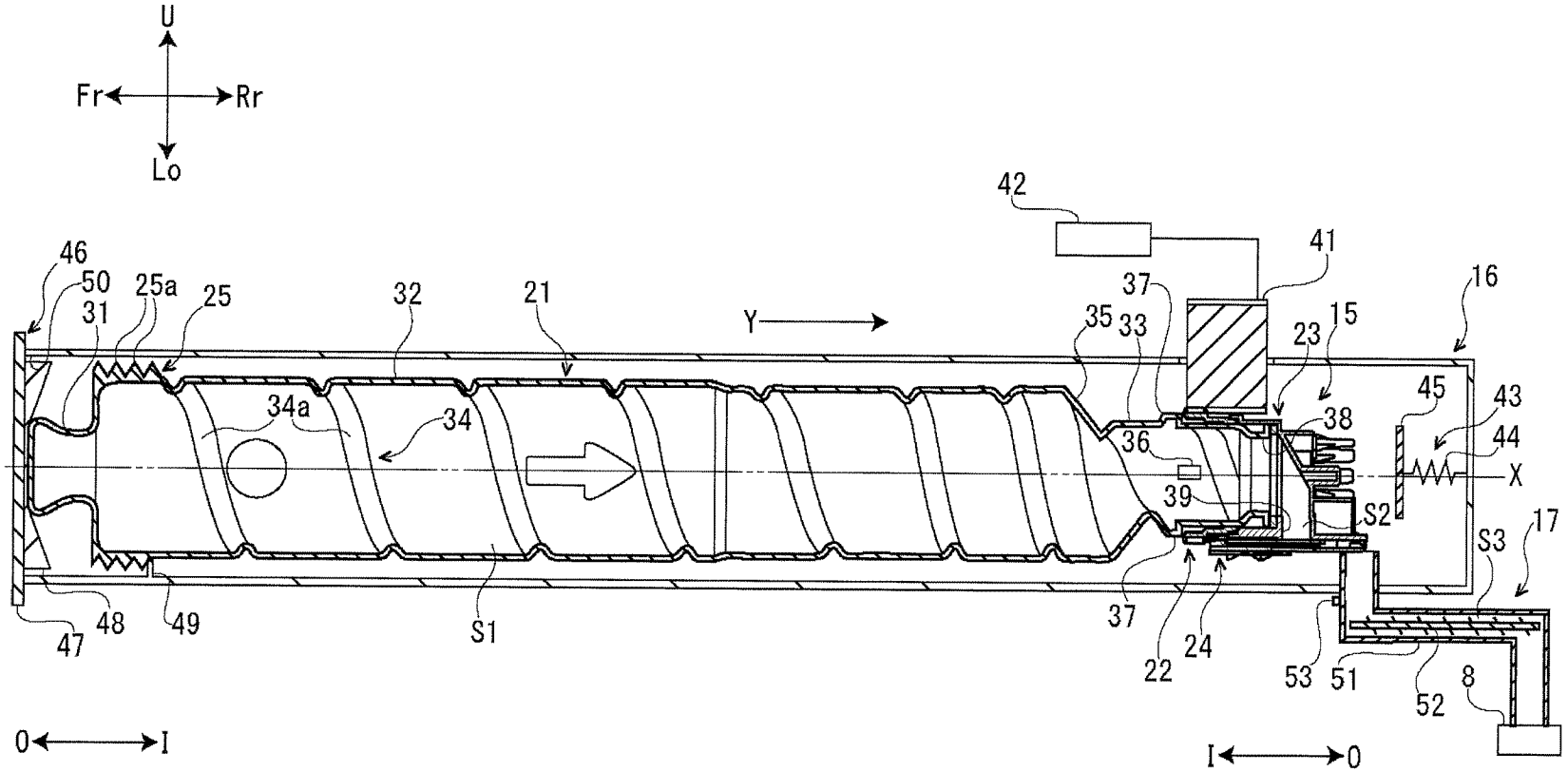
FIG. 2 illustrates a cross-sectional view illustrating a state where removal of a toner container from a mounting portion is permitted, in the image forming apparatus according to the one embodiment.
Figure 3:
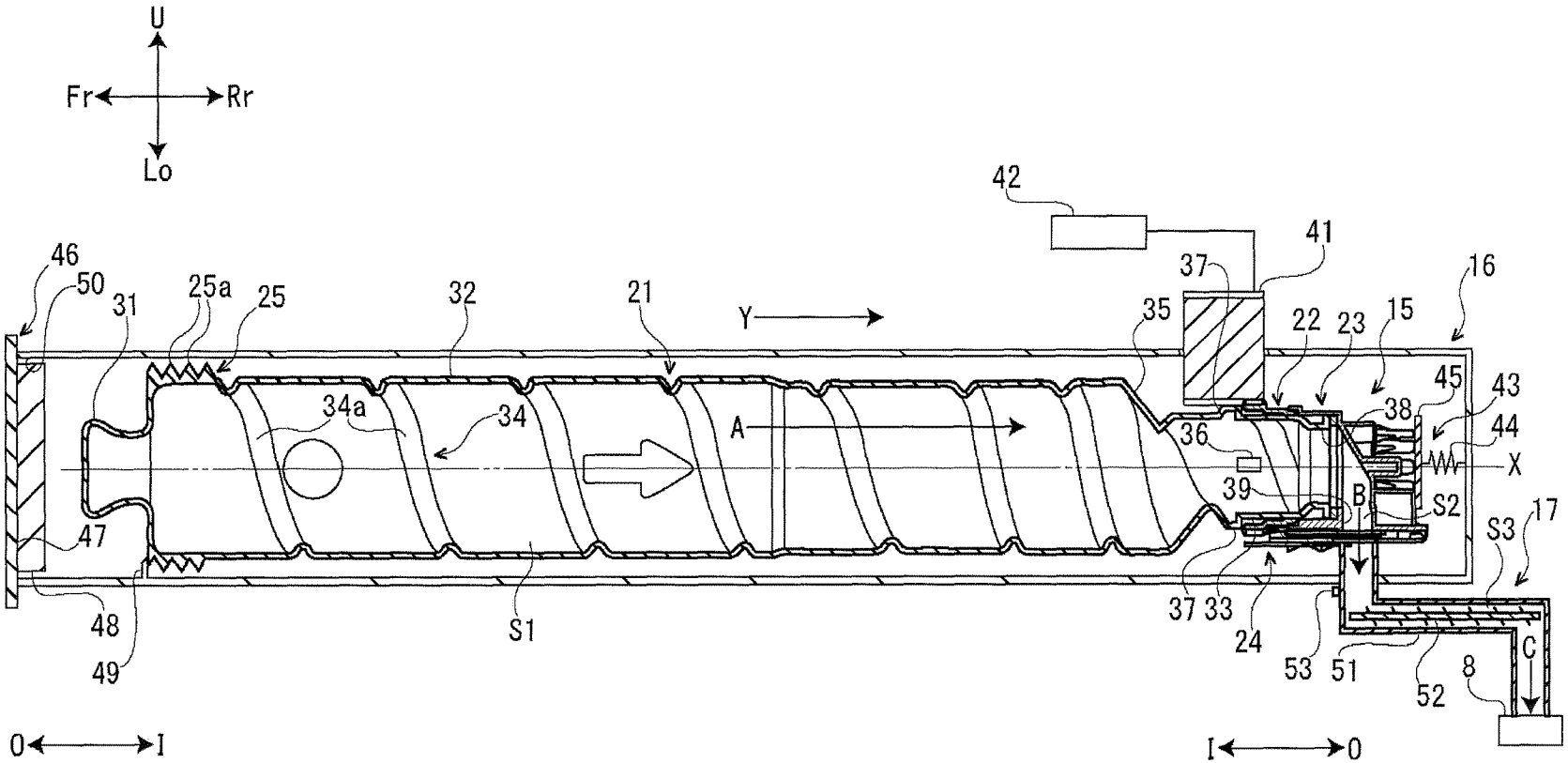
FIG. 3 illustrates a cross-sectional view illustrating a state where removal of the toner container from the mounting portion is restricted, in the image forming apparatus according to the one embodiment.

With reference to FIGS. 2 and 3, the toner container 15 is mounted to the mounting portion 16 along a mounting direction Y. The mounting direction Y is a direction heading for the rear side from the front side. In the following, the description of "a front side in the mounting direction" or "a back side in the mounting direction" indicates the front side or the back side in the mounting direction Y.

Figure 4:
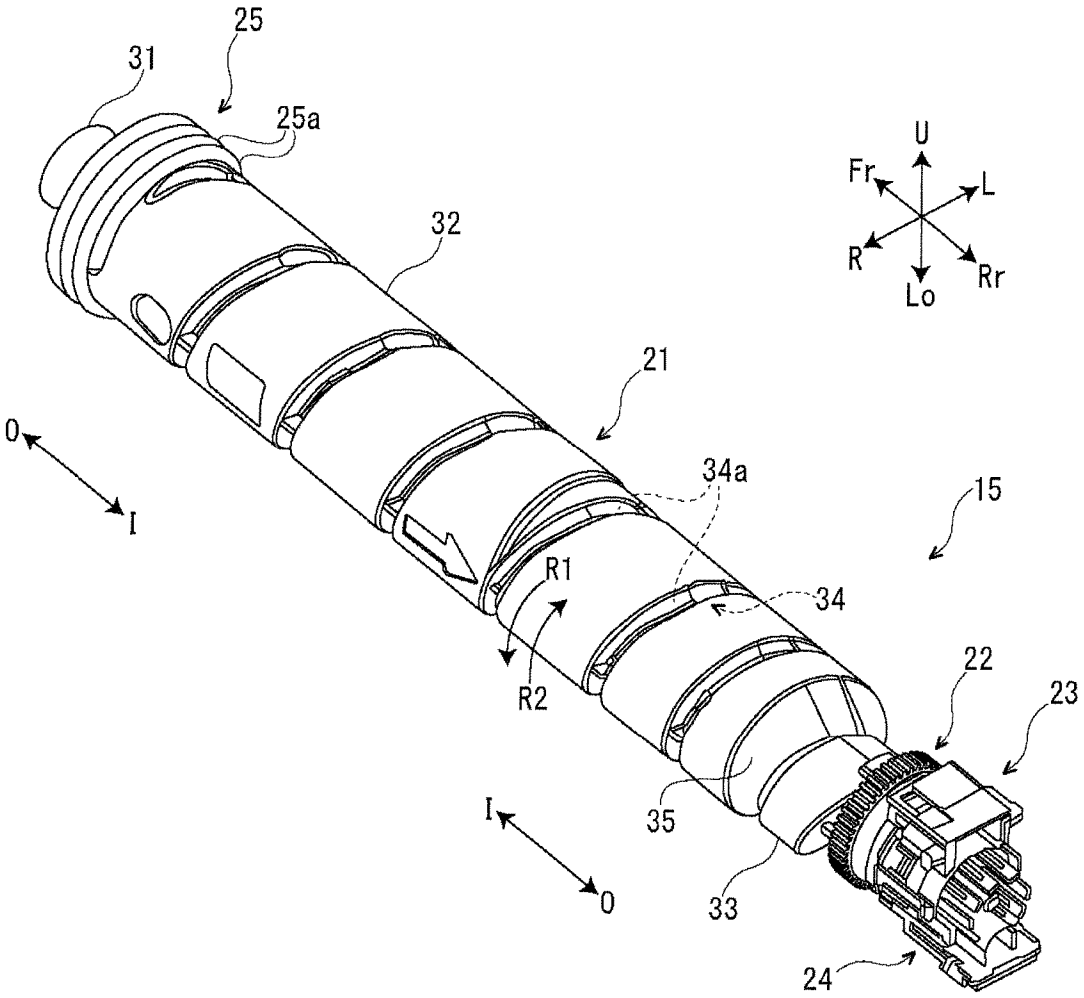
FIG. 4 obliquely illustrates a toner container according to the one embodiment.

With reference to FIG. 4, the toner container 15 includes: a container body 21; a transmission gear 22 mounted to an outer periphery of a rear portion of the container body 21; a cap 23 located on a rear side of the transmission gear 22; a shutter 24 located under the cap 23; and an engaging protrusion 25 projecting from an outer peripheral surface of a front portion of the container body 21.

With reference to FIGS. 2 to 4, the container body 21 of the toner container 15 is formed in a cylindrical shape long in the front-rear direction. The container body 21 is rotatably located around a rotation axis X extending in the front-rear direction. That is, in this embodiment, the front-rear direction is the rotation-axis direction of the container body 21. The container body 21 is located to be rotatable around both a first rotation direction R1 (one example of one rotation direction) and a second rotation direction R2 (one example of the other rotation direction) that is opposite to the first rotation direction R1.

Inside the container body 21, a housing space S1 is located. The housing space S1 houses a toner. An arrow A attached in FIG. 3 indicates a conveyance direction (hereinafter referred to as a conveyance direction A) of the toner inside the housing space S1. The conveyance direction A is a direction heading for the rear side from the front side, and corresponds to the mounting direction Y. In the following, the description of "an upstream side in the conveyance direction" or "a downstream side in the conveyance direction" indicates the upstream side or the downstream side in the conveyance direction A.

The container body 21 includes: a handle portion 31; a large-diameter cylindrical portion 32 located in the rear side (the back side (downstream) in the mounting direction) of the handle portion 31; and a small-diameter cylindrical portion 33 located in the rear side (the back side in the mounting direction) of the large-diameter cylindrical portion 32. The large-diameter cylindrical portion 32 is also referred to as "cylindrical portion."

The handle portion 31 of the container body 21 is a portion that is clasped by an operator such as a user or a serviceman when the toner container 15 is attached to and removed from the mounting portion 16. The handle portion 31 is located at the front end portion (the end portion on the front side in the mounting direction) of the container body 21. The handle portion 31 is formed in a closed-bottomed cylindrical shape with a front face closed.

On an inner peripheral surface of the large-diameter cylindrical portion 32 and the small-diameter cylindrical portion 33 of the container body 21, a conveyance protrusion 34 formed in a spiral pattern is continuously located to convey the toner in the container body 21. Respective winding portions 34*a* (portions of one turn) of the conveyance protrusion 34 are formed to incline to the front side (the upstream side in the conveyance direction) toward the first rotation direction R1. The respective winding portions 34*a* of the conveyance protrusion 34 are located at intervals with one another.

Outer diameters of the large-diameter cylindrical portion 32 and the small-diameter cylindrical portion 33 of the container body 21 are larger than an outer diameter of the handle portion 31 of the container body 21. Between the large-diameter cylindrical portion 32 and the small-diameter cylindrical portion 33, a stepped portion 35 is located. Consequently, the outer diameter of the large-diameter cylindrical portion 32 is larger than the outer diameter of the small-diameter cylindrical portion 33.

On an outer peripheral surface of the small-diameter cylindrical portion 33 of the container body 21, a pair of first protrusions 36 (only one of them is indicated in FIGS. 2 and 3) and a pair of second protrusions 37 are located. At a rear-end portion (an end portion on the downstream side in the conveyance direction of the container body 21) of the small-diameter cylindrical portion 33, an opening 38 is located.

The transmission gear 22 of the toner container 15 is formed in a cylindrical shape with the rotation shaft X as a shaft center. The transmission gear 22 is mounted onto the outer periphery of the small-diameter cylindrical portion 33 of the container body 21 at a proximity of the opening 38 of the container body 21. On an inner peripheral surface of the transmission gear 22, a plurality of engaging ribs (not illustrated) are located at intervals in the peripheral direction. Engagement of the pair of first protrusions 36 of the container body 21 with the plurality of engaging ribs restricts a relative rotation of the transmission gear 22 with respect to the container body 21.

The cap 23 of the toner container 15 is secured to the mounting portion 16, and its rotation is restricted in a state where the toner container 15 is mounted to the mounting portion 16. The rear portion of the small-diameter cylindrical portion 33 of the container body 21 is rotatably inserted into the cap 23. The cap 23 covers the opening 38 of the container body 21. The cap 23 sandwiches the transmission gear 22 with the pair of second protrusions 37 of the container body 21. This restricts a move in the front-rear direction of the transmission gear 22.

Inside the cap 23, a communication space S2 is formed. The communication space S2 communicates with the housing space S1 of the container body 21 via the opening 38 of the container body 21. On a bottom surface of the cap 23, a discharge port 39 is located on the lower side of the communication space S2.

The shutter 24 of the toner container 15 is formed in a shape long in the front-rear direction. The shutter 24 is supported by the cap 23. The shutter 24 is configured to open and close the discharge port 39 of the cap 23 by moving along the front-rear direction.

With reference to FIGS. 2 and 3, the engaging protrusion 25 of the toner container 15 projects from an outer peripheral surface of the front end portion (the end portion on the front side (upstream) in the mounting direction) of the large-diameter cylindrical portion 32 of the container body 21. The engaging protrusion 25 is integrally formed with the container body 21. The engaging protrusion 25 is located on the front side (the upstream side (upstream) in the conveyance direction) with respect to the conveyance protrusion 34 of the container body 21.

Figure 5A:
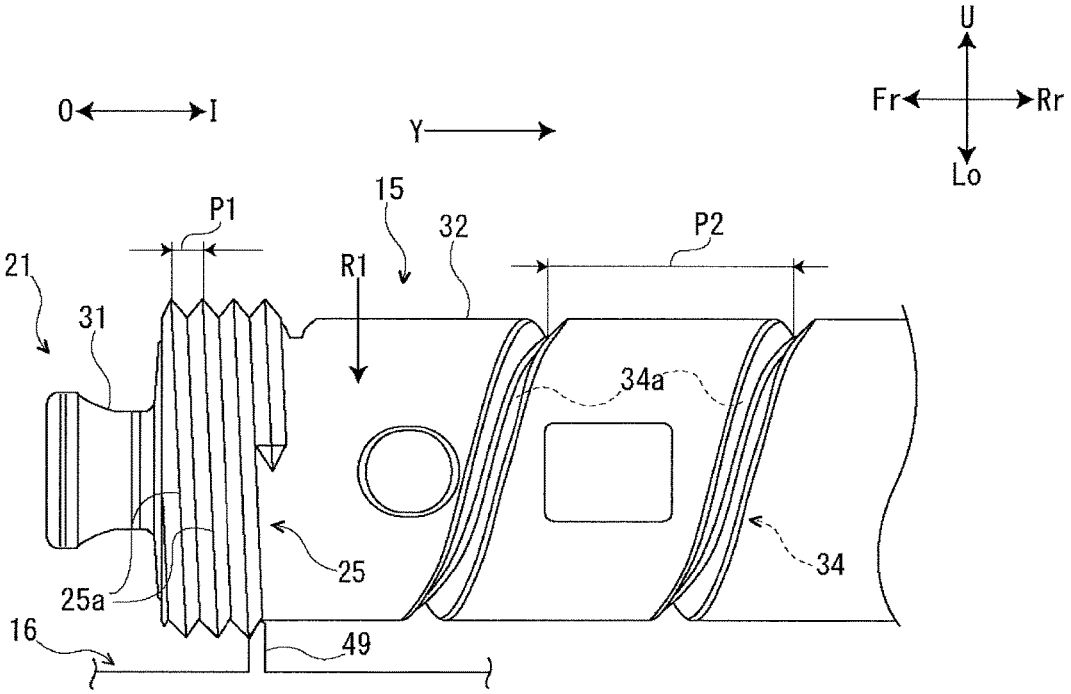
FIG. 5A illustrates a side view illustrating a state where removal of the toner container from the mounting portion is permitted, in the image forming apparatus according to the one embodiment.
Figure 5B:
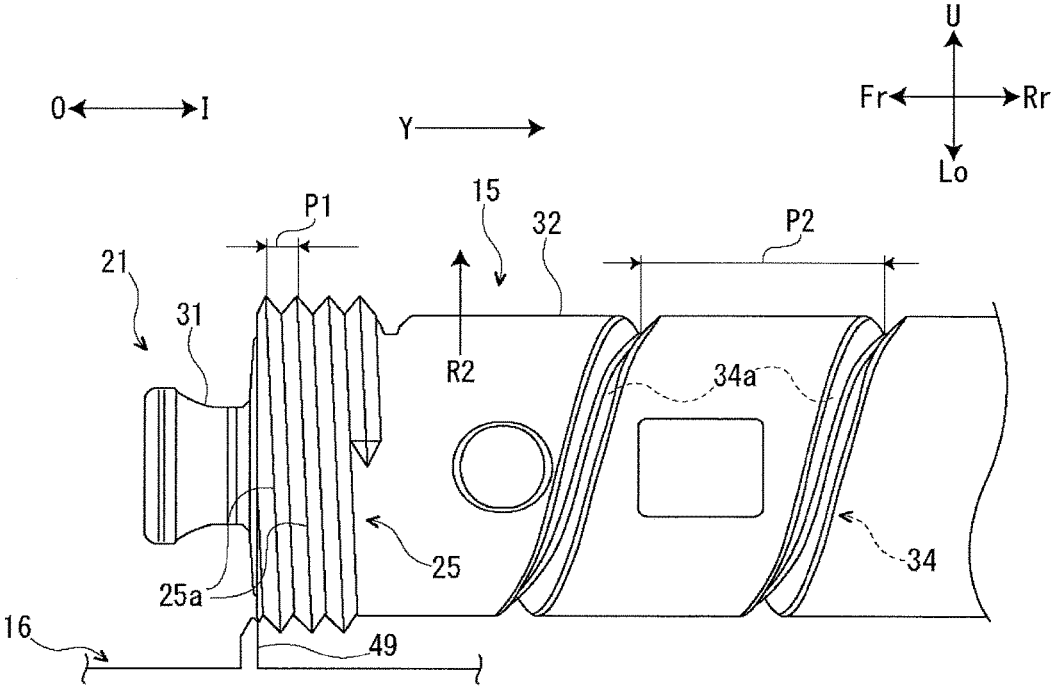
FIG. 5B illustrates a side view illustrating a state where removal of the toner container from the mounting portion is restricted, in the image forming apparatus according to the one embodiment.

With reference to FIGS. 4, 5A, and 5B, the engaging protrusion 25 is formed in a spiral pattern. Respective winding portions 25*a* (portions of one turn) of the engaging protrusion 25 are formed to incline to the rear side (the downstream side in the conveyance direction) toward the first rotation direction R1. The respective winding portions 25*a* of the engaging protrusion 25 are inclined in the opposite direction relative to the respective winding portions 34*a* of the conveyance protrusion 34 of the container body 21. The respective winding portions 25*a* of the engaging protrusion 25 are located without an interval with one another. A pitch P1 of the respective winding portions 25*a* of the engaging protrusion 25 is narrower than a pitch P2 of the respective winding portions 34*a* of the conveyance protrusion 34.

Next, a description will be further given of the four mounting portions 16. The configurations of the respective mounting portions 16 are similar; thus, in the following, one mounting portion 16 will be described, and the remaining three mounting portions 16 will not be elaborated here.

With reference to FIGS. 2 and 3, a drive gear 41 is rotatably located in the rear portion of the mounting portion 16. The drive gear 41 meshes with the transmission gear 22. A width in the front-rear direction of the drive gear 41 is wider than the width in front-rear direction of the transmission gear 22. The drive gear 41 is connected to a driving source 42 constituted with a motor that can rotate forward and reversely.

In the rear portion of the mounting portion 16, a pressing member 43 is located. The pressing member 43 includes a pressing spring 44 and a pressing plate 45 mounted to the pressing spring 44.

At the front end portion (the end portion on the front side in the mounting direction) of the mounting portion 16, a cover 46 (an exemplary pressing body) is located. The cover 46 is configured to rotate with its lower end side as a fulcrum between a closed position (see FIGS. 2 and 3), which closes a mounting port 50 opened at the front end portion of the mounting portion 16, and an open position (not illustrated), which opens the mounting port 50. The cover 46 includes a cover main body 47 that covers the mounting port 50 and an elastic body 48 that is secured to an inner surface of the cover main body 47. The elastic body 48 is constituted with, for example, a sponge.

In the front portion of the mounting portion 16, a lock portion 49 is located. The lock portion 49 projects upward from a bottom surface of the mounting portion 16.

Next, a description will be further given of the four hoppers 17. The configurations of the respective hoppers 17 are similar; thus, in the following, one hopper 17 will be described, and the remaining three hoppers 17 will not be elaborated here.

With reference to FIGS. 2 and 3, the hopper 17 includes a hopper main body 51, a screw 52 housed in the hopper main body 51, and a sensor 53 mounted to the hopper main body 51.

The hopper main body 51 of the hopper 17 is formed in a tubular shape. Inside the hopper main body 51, a connection space S3 is formed. The communication space S2 of the cap 23 is connected to an internal space of the developing device 8 via this connection space S3. An upstream portion and a downstream portion of the connection space S3 extend along the vertical direction. A midstream portion of the connection space S3 extends along a horizontal direction, and connects a lower end portion of the upstream portion of the connection space S3 to an upper end portion of the downstream portion of the connection space S3.

The screw 52 of the hopper 17 is housed in the midstream portion of the connection space S3. The screw 52 is rotatably supported by the hopper main body 51.

The sensor 53 of the hopper 17 is constituted with, for example, an optical sensor that includes a light-emitting portion and a light receiving portion. The sensor 53 is configured to detect the toner (hereinafter abbreviated as the toner inside the hopper main body 51) housed in the upstream portion of the connection space S3 of the hopper main body 51.

Next, in the image forming apparatus 1 configured as described above, a description will be given of operations of setting the toner container 15 to the mounting portion 16.

When setting the toner container 15 to the mounting portion 16, first an operator such as a user or a serviceman rotates the cover 46 up to the open position from the closed position, and then mounts the toner container 15 to the mounting portion 16 along the mounting direction Y. Thus, mounting the toner container 15 to the mounting portion 16 causes the transmission gear 22 to mesh with the drive gear 41.

Mounting the toner container 15 to the mounting portion 16 as described above causes the rear-end portion (the end portion on the back side in the mounting direction) of the engaging protrusion 25 to engage with the lock portion 49 as illustrated in FIG. 5A. In this state, extracting the toner container 15 to the front side (the front side in the mounting direction) with respect to the mounting portion 16 releases the engagement between the engaging protrusion 25 and the lock portion 49 to remove the toner container 15 from the mounting portion 16. That is, this permits removal of the toner container 15 from the mounting portion 16.

Subsequently, as illustrated in FIG. 2, the operator rotates the cover 46 up to the closed position from the open position. In association with this, the elastic body 48 of the cover 46 presses the handle portion 31 of the container body 21 toward the rear side (the back side in the mounting direction) to press the rear-end portion of the engaging protrusion 25 against the lock portion 49. That is, the cover 46 presses the rear-end portion of the engaging protrusion 25 to the lock portion 49. In this state, rotating the cover 46 from the closed position up to the open position and extracting the toner container 15 to the front side (the front side in the mounting direction) with respect to the mounting portion 16 releases the engagement between the engaging protrusion 25 and the lock portion 49 to remove the toner container 15 from the mounting portion 16. That is, this still permits the removal of the toner container 15 from the mounting portion 16. In this state, the pressing plate 45 of the pressing member 43 is separated from the cap 23.

Subsequently, the driving source 42 rotates the drive gear 41 in one direction. Rotation of the drive gear 41 in the one direction in this manner causes the transmission gear 22, which meshes with the drive gear 41, to rotate in the first rotation direction R1, and causes the container body 21 to rotate in the first rotation direction R1 integrally with the transmission gear 22. In association with this, the engaging protrusion 25 rotates in the first rotation direction R1 integrally with the container body 21.

Rotation of the engaging protrusion 25 in the first rotation direction R1 as described above displace the engaging protrusion 25 with respect to the lock portion 49. In association with this, as illustrated in FIG. 5B, while shifting an engaging part of the engaging protrusion 25 relative to the lock portion 49, the toner container 15 moves to the rear side (the back side in the mounting direction), and the front end portion (the end portion on the front side in the mounting direction) of the engaging protrusion 25 engages with the lock portion 49. This completes setting of the toner container 15 relative to the mounting portion 16.

In a state where the toner container 15 is set in the mounting portion 16 in this manner, even when it is attempted to extract the toner container 15 to the front side (the front side in the mounting direction) relative to the mounting portion 16, it is not possible to extract the toner container 15 to the front side since the engaging protrusion 25 interferes with the lock portion 49. That is, this restricts the removal of the toner container 15 from the mounting portion 16.

Setting of the toner container 15 to the mounting portion 16 as described above causes the pressing plate 45 of the pressing member 43 to press the cap 23 to the front side and causes the front end portion of the engaging protrusion 25 to be pressed to the lock portion 49 as illustrated in FIG. 3. That is, the pressing member 43 presses the front end portion of the engaging protrusion 25 against the lock portion 49. Setting the toner container 15 to the mounting portion 16 as described above causes the elastic body 48 of the cover 46 to be separated from the handle portion 31 of the container body 21.

Next, in the image forming apparatus 1 configured as described above, a description will be given of operations of replenishing toner to the developing device 8 from the toner container 15.

In replenishing toner to the developing device 8 from the toner container 15, the drive gear 41 is rotated in the above-described one direction by the driving source 42 in a state where the toner container 15 is set in the mounting portion 16. The rotation of the drive gear 41 in the one direction in this manner causes the transmission gear 22, which meshes with the drive gear 41, to rotate in the first rotation direction R1, and causes the container body 21 to rotate in the first rotation direction R1 integrally with the transmission gear 22. In association with this, the engaging protrusion 25 rotates in the first rotation direction R1 integrally with the container body 21. However, even when the engaging protrusion 25 thus rotates in the first rotation direction R1, the toner container 15 does not move any further to the rear side (the back side in the mounting direction) because the front end portion (the end portion on the front side in the mounting direction) of the engaging protrusion 25 has already engaged with the lock portion 49.

The rotation of the container body 21 in the first rotation direction R1 as described above causes the conveyance protrusion 34 in the container body 21 to convey the toner inside the housing space S1 in the container body 21 along the conveyance direction A as illustrated in FIG. 3. The toner conveyed by the conveyance protrusion 34 in this manner is discharged from the housing space S1 via the opening 38 of the container body 21 to be introduced in the communication space S2 of the cap 23. As indicated by an arrow B in FIG. 3, the toner introduced in the communication space S2 in this manner is discharged from the communication space S2 via the discharge port 39 of the cap 23 to be introduced in the connection space S3 of the hopper main body 51. The toner introduced in the connection space S3 in this manner is conveyed inside the connection space S3 by the screw 52 to be replenished to the developing device 8, as indicated by an arrow C in FIG. 3.

Next, in the image forming apparatus 1 configured as described above, a description will be given of operations of removing the toner container 15 from the mounting portion 16.

In a state where the toner container 15 is set in the mounting portion 16, when the sensor 53 does not detect the toner inside the hopper main body 51 even when the container body 21 is rotated in the first rotation direction R1 for a predetermined time, the toner inside the container body 21 is empty. In this case, the drive gear 41 is rotated in a direction opposite to the above-described one direction by the driving source 42. The rotation of the drive gear 41 in the opposite direction in this manner rotates the transmission gear 22, which is meshed with the drive gear 41, in the second rotation direction R2, and causes the container body 21 to rotate in the second rotation direction R2 integrally with the transmission gear 22. In association with this, the engaging protrusion 25 rotates in the second rotation direction R2 integrally with the container body 21.

The rotation of the engaging protrusion 25 in the second rotation direction R2 as described above displaces the engaging protrusion 25 with respect to the lock portion 49. In association with this, as illustrated in FIG. 5A, while shifting the engaging part of the engaging protrusion 25 relative to the lock portion 49, the toner container 15 moves to the front side (the front side in the mounting direction), and the rear-end portion (the end portion on the back side in the mounting direction) of the engaging protrusion 25 engages with the lock portion 49. This permits the removal of the toner container 15 from the mounting portion 16.

Subsequently, the operator rotates the cover 46 from the closed position up to the open position to extract the toner container 15 to the front side (the front side in the mounting direction) with respect to the mounting portion 16. This removes the toner container 15 from the mounting portion 16.

In this embodiment, the rotation of the container body 21 and the engaging protrusion 25 in the first rotation direction R1 in a state where the removal of the toner container 15 from the mounting portion 16 is permitted causes the toner container 15 to move in the rear side (the back side (downstream) in the mounting direction) while shifting the engaging part of the engaging protrusion 25 relative to the lock portion 49 to restrict the removal of the toner container 15 from the mounting portion 16. Employing such configuration enables the restriction of the removal of the toner container 15 from the mounting portion 16 by using a simple configuration, without using a complicated lock mechanism. Therefore, this ensures reduced complexity of the configuration of the image forming apparatus 1 and reduced rise in production cost of the image forming apparatus 1.

The respective winding portions 34*a* of the conveyance protrusion 34 are formed to incline to the front side (the upstream side in the conveyance direction) toward the first rotation direction R1, and the respective winding portions 25*a* of the engaging protrusion 25 are formed to incline to the rear side (the downstream side in the conveyance direction) toward the first rotation direction R1. That is, the respective winding portions 25*a* of the engaging protrusion 25 are inclined in a direction opposite to the respective winding portions 34*a* of the conveyance protrusion 34. Employing such configuration enables orienting the rotation direction of the container body 21 and the engaging protrusion 25 in setting the toner container 15 to the mounting portion 16 to the rotation direction of the container body 21 and the engaging protrusion 25 in discharging the toner from the container body 21. In association with this, this ensures smooth transition from the operation of setting the toner container 15 to the mounting portion 16 to the operation of discharging the toner from the container body 21.

The engaging protrusion 25 is located on the front side (the upstream side in the conveyance direction) with respect to the conveyance protrusion 34, and the pitch P1 of the respective winding portions 25*a* of the engaging protrusion 25 is narrower than the pitch P2 of the respective winding portions 34*a* of the conveyance protrusion 34. Employing such configuration enables effective use of the narrow space on the front side (the upstream side in the conveyance direction) with respect to the conveyance protrusion 34 as an arrangement space of the engaging protrusion 25.

The outer diameter of the large-diameter cylindrical portion 32 is larger than the outer diameter of the handle portion 31, and the engaging protrusion 25 projects from the outer peripheral surface of the front end portion (the end portion on the front side in the mounting direction) of the large-diameter cylindrical portion 32. Employing such configuration enables facilitated engagement of the engaging protrusion 25 with the lock portion 49.

The engaging protrusion 25 is integrally formed with the container body 21. Employing such configuration enables reduced increase of component count of the image forming apparatus 1 and reduced complexity of the configuration of the image forming apparatus 1 more effectively.

The rotation of the container body 21 and the engaging protrusion 25 in the second rotation direction R2 in a state where the removal of the toner container 15 from the mounting portion 16 is restricted causes the toner container 15 to move to the front side (the front side (upstream) in the mounting direction) while shifting the engaging part of the engaging protrusion 25 relative to the lock portion 49 to permit the removal of the toner container 15 from the mounting portion 16. Employing such configuration enables the transition from the state where the removal of the toner container 15 from the mounting portion 16 is restricted to the state where the removal of the toner container 15 from the mounting portion 16 is permitted with the simple configuration.

When the sensor 53 does not detect the toner inside the hopper main body 51 even when the container body 21 is rotated in the state where the removal of the toner container 15 from the mounting portion 16 is restricted, the container body 21 and the engaging protrusion 25 are rotated in the second rotation direction R2. Employing such configuration enables rotating the container body 21 and the engaging protrusion 25 in the second rotation direction R2 at a phase where the toner inside the container body 21 has become empty to permit the removal of the toner container 15 from the mounting portion 16, and this surely ensures using up the toner inside the container body 21.

The pressing member 43 presses the engaging protrusion 25 to the lock portion 49 in the state where the removal of the toner container 15 from the mounting portion 16 is restricted. Employing such configuration surely enables shifting the engaging part of the engaging protrusion 25 relative to the lock portion 49 when the engaging protrusion 25 rotates in the second rotation direction R2, and thus, this surely ensures moving the toner container 15 to the front side (the front side in the mounting direction).

The cover 46 presses the engaging protrusion 25 to the lock portion 49 in the state where the removal of the toner container 15 from the mounting portion 16 is permitted. Employing such configuration surely enables shifting the engaging part of the engaging protrusion 25 relative to the lock portion 49 when the engaging protrusion 25 rotates in the first rotation direction R1, and thus, this surely ensures moving the toner container 15 to the rear side (the back side in the mounting direction).

In the embodiment, the engaging protrusion 25 projects from the outer peripheral surface of the large-diameter cylindrical portion 32. Meanwhile, in other different embodiments, the engaging protrusion 25 may project from the outer peripheral surface of the handle portion 31 or the small-diameter cylindrical portion 33. That is, the engaging protrusion 25 may project from the outer peripheral surface of any portion of the container body 21.

In the embodiment, the respective winding portions 25*a* of the engaging protrusion 25 are located without an interval with one another. Meanwhile, in other different embodiments, the respective winding portions 25*a* of the engaging protrusion 25 may be located at intervals with one another.

In the embodiment, the engaging protrusion 25 is integrally formed with the container body 21. Meanwhile, in other different embodiments, the engaging protrusion 25 may be separately formed from the container body 21.

In the embodiment, the sensor 53 detects the toner inside the hopper 17. Meanwhile, in other different embodiments, the sensor 53 may detect the toner inside the developing device 8 or the toner container 15.

In the embodiment, the toner container 15 is connected to the developing device 8 via the hopper 17. Meanwhile, in other different embodiments, the toner container 15 may be directly connected to the developing device 8.

In the embodiment, the pressing member 43 is separated from the cap 23 in the state where the removal of the toner container 15 from the mounting portion 16 is permitted. Meanwhile, in other different embodiments, the pressing member 43 may be in contact with a part of the toner container 15 in the state where the removal of the toner container 15 from the mounting portion 16 is permitted.

In the embodiment, the cover 46 is separated from the container body 21 in the state where the removal of the toner container 15 from the mounting portion 16 is restricted. Meanwhile, in other different embodiments, the cover 46 may be in contact with a part of the toner container 15 in the state where the removal of the toner container 15 from the mounting portion 16 is restricted.

In the embodiment, the image forming apparatus 1 is a multi-functional peripheral. Meanwhile, in other different embodiments, the image forming apparatus 1 may be a printer, a copying machine, a facsimile, or similar apparatus.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising, a toner container;

a mounting portion where the toner container is mounted along a mounting direction; and a driving source, wherein the toner container includes:

a container body that houses a toner and rotates by the driving source;

an engaging protrusion that projects from an outer peripheral surface of the container body, the engaging protrusion having a spiral pattern and rotating integrally with the container body, the mounting portion includes a lock portion engageable with the engaging protrusion, rotation of the container body and the engaging protrusion in one rotation direction in a state where removal of the toner container from the mounting portion is permitted causes the toner container to move downstream in the mounting direction while shifting an engaging part of the engaging protrusion relative to the lock portion to restrict the removal of the toner container from the mounting portion, on an inner peripheral surface of the container body, a conveyance protrusion with a spiral pattern that conveys the toner inside the container body is located along a conveyance direction oriented to the mounting direction, the engaging protrusion is located upstream with respect to the conveyance protrusion in the conveyance direction, and the spiral pattern of the engaging protrusion have a pitch narrower than a pitch of the spiral pattern of the conveyance protrusion.

2. The image forming apparatus according to claim 1, wherein rotation of the container body and the engaging protrusion in the other rotation direction opposite to the one rotation direction in a state where the removal of the toner container from the mounting portion is restricted causes the toner container to move upstream in the mounting direction while shifting the engaging part of the engaging protrusion relative to the lock portion to permit the removal of the toner container from the mounting portion.

3. The image forming apparatus according to claim 2, further comprising:

an image carrier where an electrostatic latent image is formed;

a developing device that develops the electrostatic latent image formed on the image carrier;

a hopper that connects the toner container to the developing device; and a sensor that detects a toner inside the hopper, wherein when the toner inside the hopper is undetected by the sensor even when the container body is rotated in a state where the removal of the toner container from the mounting portion is restricted, the container body and the engaging protrusion rotate in the other rotation direction.

4. The image forming apparatus according to claim 2, further comprising a pressing member that presses the engaging protrusion against the lock portion in a state where the removal of the toner container from the mounting portion is restricted.

5. The image forming apparatus according to claim 1, further comprising a pressing body that presses the engaging protrusion against the lock portion in a state where the removal of the toner container from the mounting portion is permitted.

6. The image forming apparatus according to claim 1, wherein the container body includes:

a handle portion; and a cylindrical portion located downstream in the mounting direction of the handle portion, wherein the cylindrical portion has an outer diameter larger than an outer diameter of the handle portion, and the engaging protrusion projects from an outer peripheral surface of an end portion upstream in the mounting direction of the cylindrical portion.

7. The image forming apparatus according to claim 1, wherein the engaging protrusion is formed integrally with the container body.

* * * * *